US009283754B2

(12) United States Patent
Iwakura

(10) Patent No.: US 9,283,754 B2
(45) Date of Patent: Mar. 15, 2016

(54) RECORDING APPARATUS

(71) Applicant: CANON KABUSHIKI KAISHA, Tokyo (JP)

(72) Inventor: Koya Iwakura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/035,428

(22) Filed: Sep. 24, 2013

(65) Prior Publication Data

US 2014/0085378 A1 Mar. 27, 2014

(30) Foreign Application Priority Data

Sep. 26, 2012 (JP) ..... 2012-212298

(51) Int. Cl.
*B41J 23/00* (2006.01)
*B41J 2/14* (2006.01)
*B41J 2/175* (2006.01)

(52) U.S. Cl.
CPC . *B41J 2/14* (2013.01); *B41J 2/1752* (2013.01)

(58) Field of Classification Search
CPC .. B41J 2/1752; B41J 2/17523; B41J 2/17526; B41J 2/17553; B41J 23/00; B41J 2/14
USPC ..... 347/37, 86, 87, 91
See application file for complete search history.

(56) References Cited

U.S. PATENT DOCUMENTS 7,549,714 B2 * 6/2009 Samoto ..... 347/8

FOREIGN PATENT DOCUMENTS

JP 2000-071545 A 3/2000

* cited by examiner

*Primary Examiner* — Justin Seo
*Assistant Examiner* — Michael Konczal
(74) *Attorney, Agent, or Firm* — Canon USA Inc. IP Division

(57) ABSTRACT

A recording apparatus includes a carriage configured to perform scanning and to detachably hold a recording head for performing recording on a recording material, a fixation member configured to fix the recording head to the carriage, a moving member arranged to be movable in a moving direction parallel to a conveyance direction of the recording material and configured to move to a first position to cause the fixation member to press-contact the recording head and to a second position to cause the fixation member to retract from the recording head, and a guide portion provided on the moving member and configured to guide the recording head when the recording head is being attached to the carriage.

13 Claims, 7 Drawing Sheets

RECORDING APPARATUS

BACKGROUND OF THE INVENTION

1. Field of the Invention

The present invention relates to a recording apparatus in which a liquid tank storing liquid is detachably attached to a recording unit of a recording head configured to discharge the liquid.

2. Description of the Related Art

An inkjet recording apparatus is equipped with a recording head configured to discharge liquid ink to perform recording on a recording material such as a recording sheet, and a carriage carrying the recording head. While the carriage moves in a direction orthogonal to the conveyance direction of the recording sheet (a main scanning direction), ink is discharged onto the recording sheet from the recording head, whereby recording is performed.

With the recent reduction in the size of recording apparatuses, there has been a tendency that the space available for the attachment of the recording head to the carriage is to be diminished. In addition, a reduction in the production cost of recording apparatuses is in progress, resulting in an increase in the number of recording apparatuses in which the upper portion of the carriage of the recording unit is covered with a casing and in which the upper portion of the carriage is unopenable to the exterior of the recording apparatus. Thus, there is a demand for a construction allowing the recording head to be attached to the carriage in a stable manner with a little space.

Japanese Patent Application Laid-Open No. 2000-71545 discusses a recording apparatus including a carriage configured to hold a recording head and to perform reciprocal scanning, and a head holder mounted on the carriage and configured to perform positioning and fixation of the recording head with respect to the carriage while holding the recording head. The carriage and the head holder are provided with a guide member configured to regulate the attitude of the recording head with respect to the carriage when the recording head is attached to the carriage, thus performing positioning.

However, the conventional construction as discussed in Japanese Patent Application Laid-Open No. 2000-71545 involves the following problem.

In the conventional construction, the upper portion of the carriage is unopenable to the exterior, so that the recording head needs to be inserted into the recording apparatus substantially from the front side of the recording apparatus, i.e., in a direction orthogonal to the carriage scanning direction and parallel to the recording sheet conveyance direction. That is, it is necessary to employ a construction in which the recording head inserted from the front side of the recording apparatus is attached to a predetermined head attachment position of the carriage. However, in such construction, it is difficult to be in conformity with the structure protecting the ink discharge surface of the recording head to be attached to the carriage from damage and smoothly guiding the recording head to the carriage.

Further, in the construction in which the upper portion of the recording unit is unopenable to the exterior of the recording apparatus, it is desirable for a recording head attachment/detachment lever to operate in the front-back direction of the recording apparatus from the viewpoint of the inner space of the recording apparatus. However, it is difficult to conform to such operation.

SUMMARY OF THE INVENTION

The present invention is directed to a recording apparatus in which, even with a construction in which the upper portion of a carriage is unopenable to an exterior of the recording apparatus, the recording head is detachably attachable to the carriage, making it possible to achieve a reduction in the size of the recording apparatus and a reduction in production cost.

According to an aspect of the present invention, a recording apparatus includes a carriage configured to perform scanning and to detachably hold a recording head for performing recording on a recording material, a fixation member configured to fix the recording head to the carriage, a moving member arranged to be movable in a moving direction parallel to a conveyance direction of the recording material and configured to move to a first position to cause the fixation member to press-contact the recording head and to a second position to cause the fixation member to retract from the recording head, and a guide portion provided on the moving member and configured to guide the recording head when the recording head is being attached to the carriage.

Further features of the present invention will become apparent from the following description of exemplary embodiments with reference to the attached drawings.

DESCRIPTION OF THE EMBODIMENTS

Figure 1:
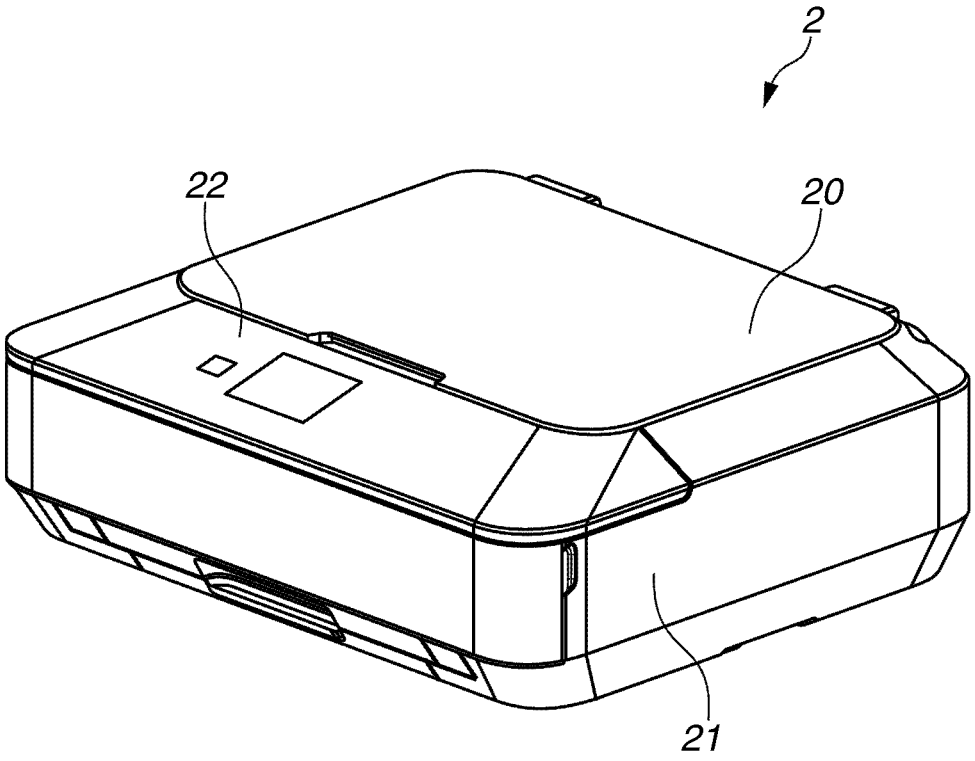
FIG. 1 is a perspective view of a recording apparatus.
Figure 2A:
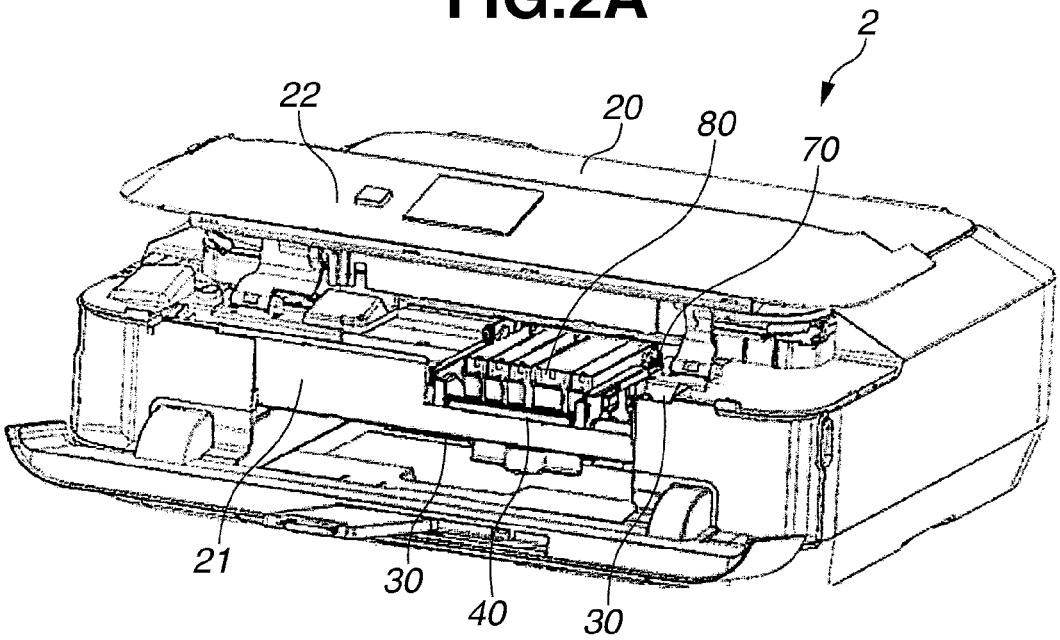
FIGS. 2A and 2B are perspective views illustrating the recording apparatus when an ink tank and a recording head are replaced.
Figure 2B:
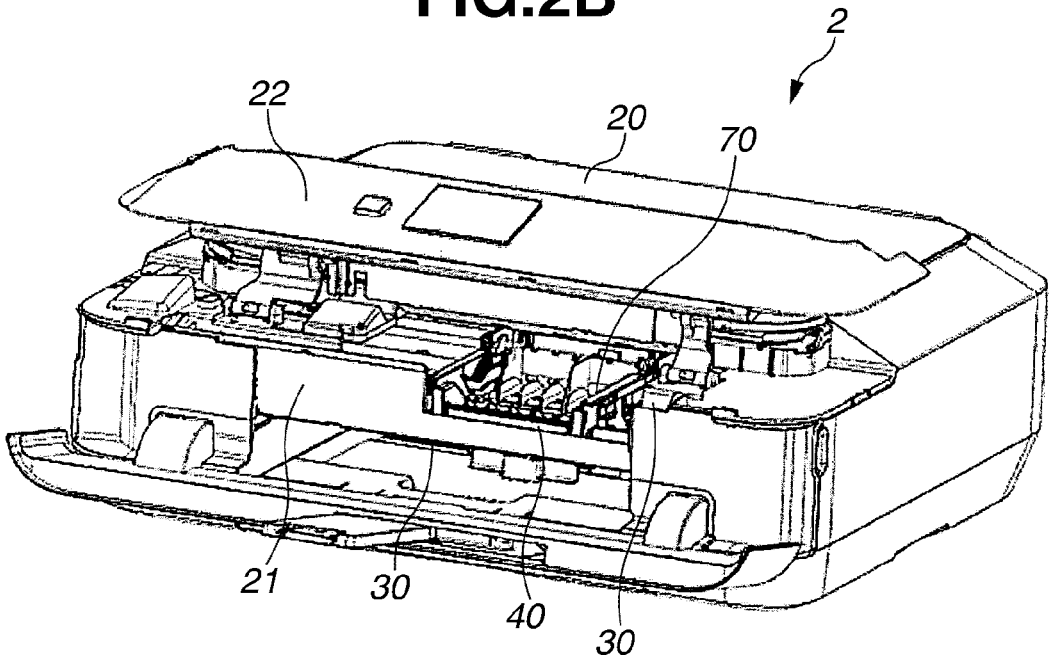
Figure 3A:
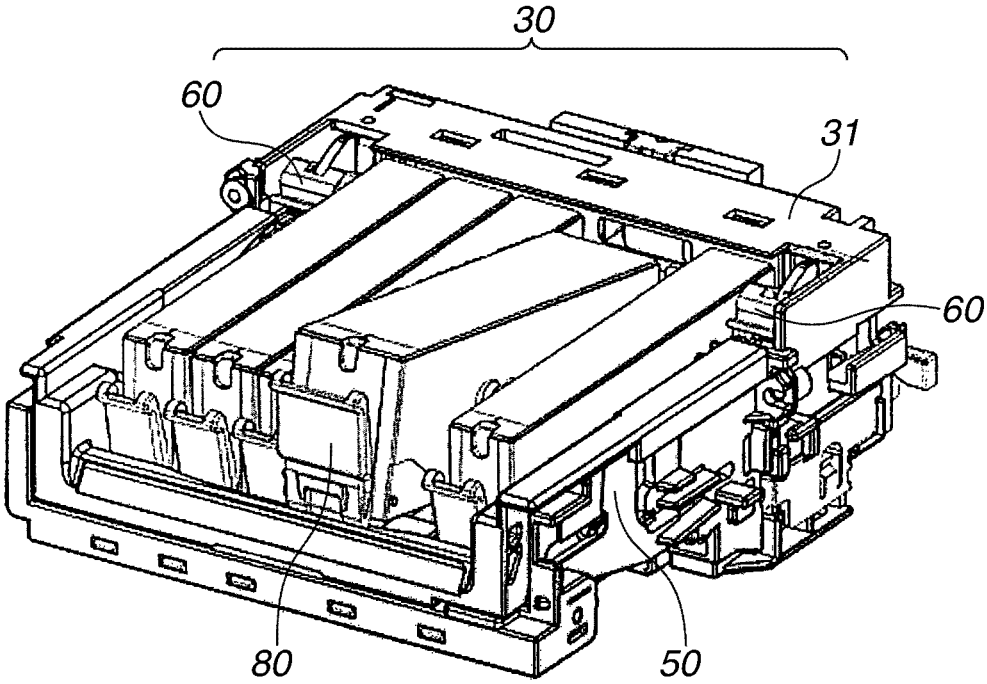
FIGS. 3A and 3B are perspective views for illustrating an ink tank attaching/detaching operation.
Figure 3B:
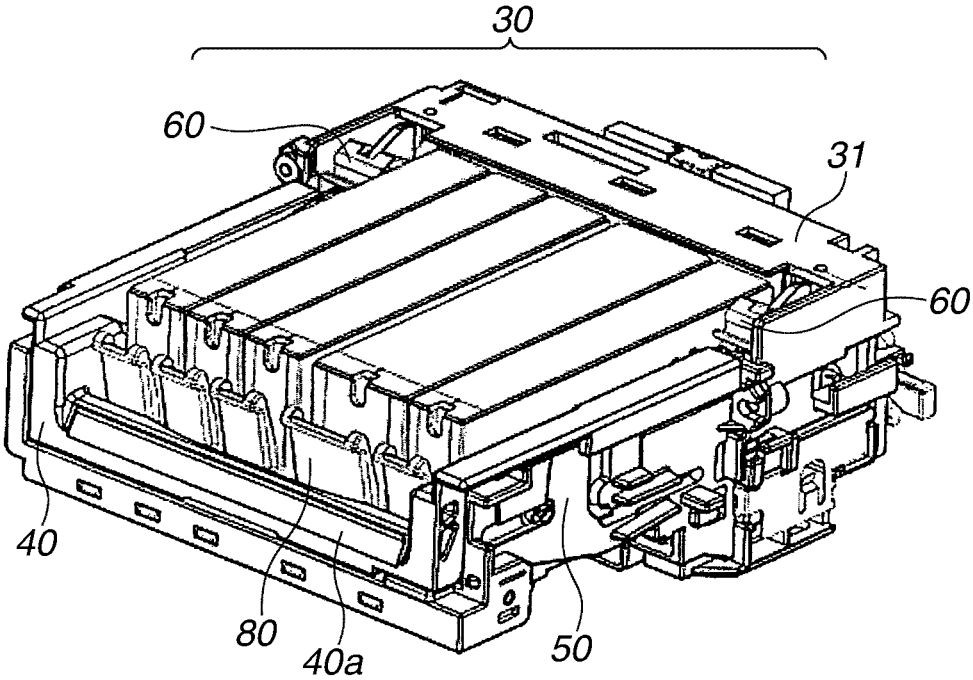
Figure 4:
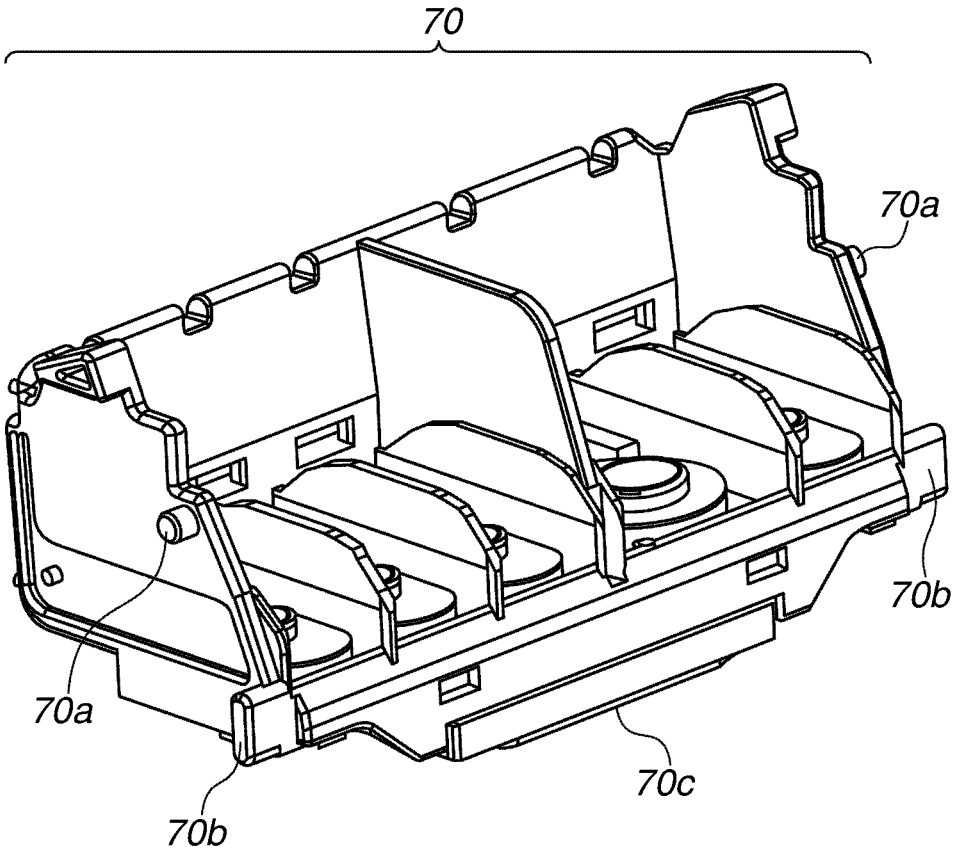
FIG. 4 is a schematic perspective view of the recording head.

In the drawings, the same reference numerals indicate the same or equivalent portions. FIG. 1 is a schematic perspective view of a recording apparatus. FIGS. 2A and 2B are schematic perspective views illustrating the recording apparatus when an ink tank and a recording head are replaced. FIGS. 3A and 3B are schematic perspective views of a recording unit, illustrating an ink tank attaching/detaching operation. FIG. 4 is a schematic perspective view of the recording head.

As illustrated in FIGS. 2A and 2B, and FIGS. 3A and 3B, in a serial-type recording apparatus 2 according to the present exemplary embodiment, a recording head 70 held by a carriage 31, capable of reciprocal scanning, of a recording unit 30 forms an image while performing scanning on a recording sheet (not illustrated) as a recording material.

First, the overall construction of the recording apparatus 2 will be described. The recording apparatus 2 is equipped with a sheet feeding unit (not illustrated), a conveyance unit (not illustrated), a recording unit 30, a maintenance unit (not illustrated), a scanner unit 20, an exterior 21, and an operation unit 22. The scanner unit 20 is fixed to the recording apparatus 2, and is not opened or closed with respect to the exterior 21. At the time of recording operation, a part of the exterior 21 is opened, whereby a discharge port for the recording sheet is secured on the front side of the recording apparatus 2. At the time of recording operation, the recording sheet fed by the sheet feeding unit is conveyed to the conveyance unit, and recording is performed by the recording head 70 provided on the carriage 31 configured to perform scanning in a main scanning direction. Then, the recording sheet is discharged to the front side of the recording apparatus 2.

Next, the carriage of the recording unit 30 will be described with reference to FIGS. 3A and 3B and FIG. 4. At a position opposite the recording sheet, the recording head 70 is provided with an ink discharge portion 70*c* configured to discharge ink for recording an image. The recording head 70 is detachably attached to the head attachment position of the carriage 31, which is capable of reciprocal movement and provided in the width direction of the recording sheet.

The carriage 31 is driven by a motor (not illustrated) mounted on a chassis unit (not illustrated) via a timing belt (not illustrated). The timing belt is stretched, with a fixed tension being applied thereto by an idler pulley (not illustrated) arranged on the opposite side of the motor. The timing belt is connected to the carriage 31, and a code strip (not illustrated) for detecting the position of the carriage 31 is provided parallel to the timing belt. Marks are formed on the cod strip at a pitch, for example, of 150 to 300 per inch. An encoder sensor (not illustrated) for reading the code strip (not illustrated) is mounted on the carriage 31.

The recording head 70 is an inkjet-type recording head configured to discharge ink onto the recording sheet from the ink discharge portion (the discharge surface where discharge ports are arranged) 70*c* based on image information. It is necessary to provide a predetermined distance (gap) (e.g., approximately 0.5 mm to 5.0 mm) for allowing ink droplets to fly between the ink discharge portion 70*c* of the recording head 70 and the recording surface of the recording sheet. As the recording material, it is possible to employ, apart from a recording sheet, ones of various materials and forms, such as cloth, information media, such as a compact disc (CD) and a digital versatile disc (DVD), a plastic sheet, an overhead projector (OHP) sheet, and an envelope, so long as they allow landing of ink droplets for image formation.

The carriage 31 is supported while guided to be capable of reciprocal movement with respect to the main scanning direction crossing (i.e., orthogonal to) the conveyance direction of the recording sheet (a sub scanning direction).

Next, the operation of attaching/detaching an ink tank 80 to/from the carriage 31 will be described with reference to FIGS. 3A and 3B. FIG. 3A illustrates the ink tank 80 as being attached or detached, and FIG. 3B is a schematic perspective view illustrating the ink tank 80 as attached.

The ink tank 80 is a liquid tank storing liquid ink to be supplied to the recording head 70, and is detachably attachable to the carriage 31 with the recording head 70 attached thereto. As illustrated in FIGS. 3A and 3B, the recording unit 30 is equipped with the carriage 31, a carriage holder 50, a recording head attachment/detachment lever 40, and a recording head fixation member 60. In the state in which the recording head 70 is attached to the recording unit 30, the ink tank 80 is inserted from the front side of the recording apparatus 2, and the front portion of the ink tank 80 is hooked on the recording head 70. Subsequently, the ink tank 80 is attached to the carriage 31 by downward forcing-in a grasping portion of the ink tank 80. When the ink tank 80 is to be detached, the grasping portion of the ink tank 80 is forced-in to detach a latch portion of the grasping portion. The ink tank 80 is pulled toward the front side of the recording apparatus 2, whereby it is detached from the carriage 31.

Next, the operation of attaching/detaching the recording head 70 to/from the carriage 31, which is performed by the user, will be described with reference to FIGS. 4, 5A, 5B, 5C, and 5D, and 6A, 6B, 6C, and 6D. FIGS. 5A, 5B, 5C, and 5D, and 6A, 6B, 6C, and 6D are perspective views for illustrating the operation of attaching the recording head 70.

The recording head 70 is formed in a box-like configuration opened at two outer peripheral portions, and has, under itself, the ink discharge portion 70*c* for discharging the liquid. An ink tank attachment portion is provided on the upper portion of the recording head 70. Further, when the recording head 70 is being attached to the carriage 31, the recording head 70 is guided by first and second head guide portions 40*b* and 40*c* as guide members provided on the recording unit 30 described below. In this connection, there are respectively provided on both side surfaces of the recording head 70 a first head guide portion 70*a* and a second head guide portion 70*b* to be guided by the first and second head guide portions 40*b* and 40*c* when the recording head 70 is being attached to the carriage 31. With the guiding of the first and second head guide portions 70*a* and 70*b*, the recording head 70 can be smoothly attached to the carriage 31 without damage on the ink discharge portion 70*c*.

Figure 5A:
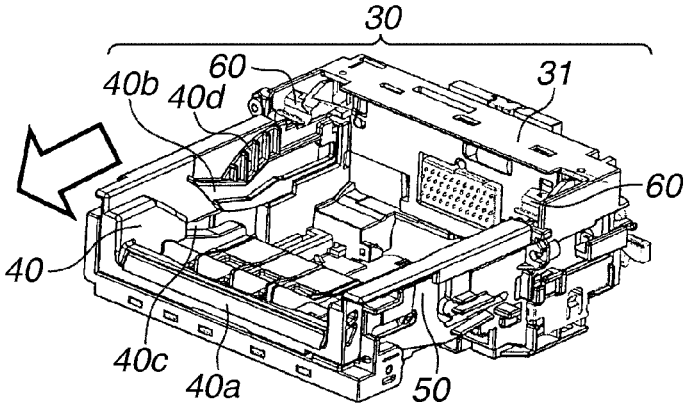
FIGS. 5A, 5B, 5C, and 5D are schematic perspective views for illustrating a recording head attaching operation.

When attaching the recording head 70 to the carriage 31, an operation portion 40*a* provided on the recording head attachment/detachment lever 40 is first pulled to the front side, i.e., in the direction indicated by the arrow in FIG. 5A. The recording head attachment/detachment lever 40 is provided to be movable in a direction crossing the moving direction of the carriage 31 and parallel to the conveyance direction of the recording sheet (the front-back direction of the recording apparatus 2). By being moved in the front-back direction of the recording apparatus 2, the recording head attachment/detachment lever 40 is moved to a closed position to cause the recording head fixation member 60 to press-contact the recording head 70, and to an opened position to cause the recording head fixation member 60 to retract from the recording head 70.

Further, on its both side surfaces facing the inner side of the carriage 31, the recording head attachment/detachment lever 40 is respectively provided with the first head guide portion 40*b* and the second head guide portion 40*c* for guiding the attaching/detaching direction of the recording head 70 to the carriage 31. Further, mounted to the carriage 31 is the recording head fixation member 60 for fixing the recording head 70 attached to the head attachment position of the carriage 31. In the state illustrated in FIG. 5A, a pushing-down force is acting on the head fixation member 60, striving to force it into the lower portion of the carriage 31, and the pushing-down force is received by the recording head attachment/detachment lever 40.

Figure 5B:
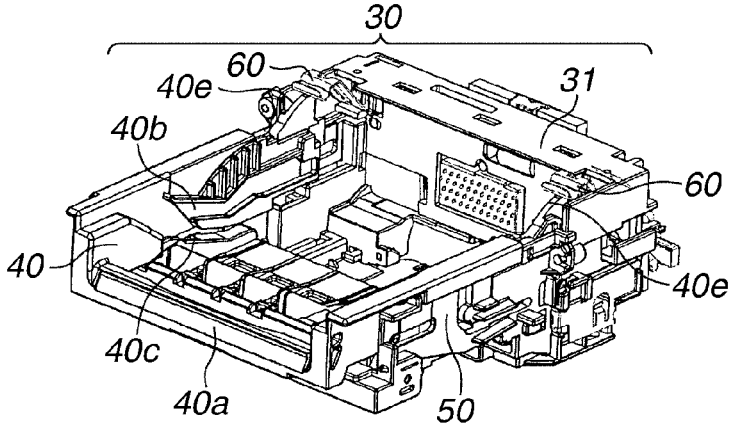

As illustrated in FIG. 5B, by moving the recording head attachment/detachment lever 40 forwards, the recording head fixation member 60 is raised by a recording head fixation member raising cam portion 40*e*. In this state, the recording head attachment/detachment lever 40 is stabilized in a state in which it has been moved to the front side of the recording apparatus 2.

Figure 5C:
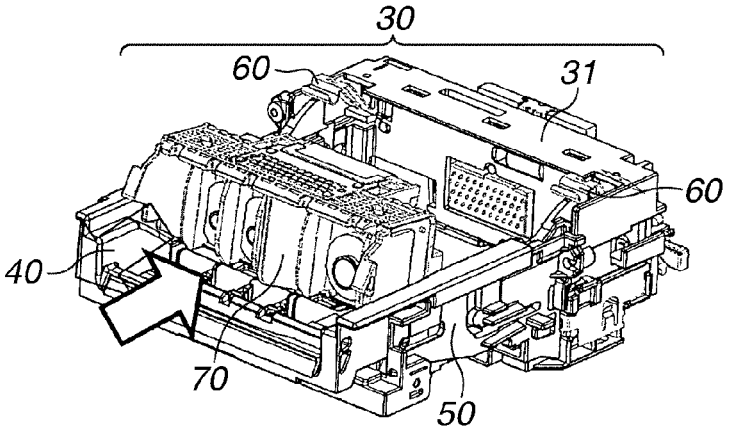

In the state, the recording head 70 is inserted into the recording unit 30 from the direction of the arrow in FIG. 5C (from the front side of the recording apparatus 2), which is parallel to the moving direction of the recording head attachment/detachment lever 40. At this time, the second head guide portion 70*b* of the recording head 70 is guided by the second head guide portion 40*c*, and, at the same time, the first head guide portion 70*a* is guided by the first head guide portion 40*b*. As a result, the attitude of the recording head 70 is regulated with predetermined play. In this way, the attitude of the recording head 70 is regulated, whereby, when the recording head 70 is attached to the head attachment position of the carriage 31, it is possible to prevent the ink discharge portion 70*c* of the recording head 70 from coming into contact with a component of the recording head 30 to suffer damage. Further, by thus regulating the recording head 70, even in the case of a structure in which the upper portion of the carriage is covered with the exterior 21, such as a cover or an outer casing, it is possible to utilize a small attachment space and to smoothly attach the recording head 70 to the head attachment position of the recording head 70 without having to search therefor.

Figure 5D:
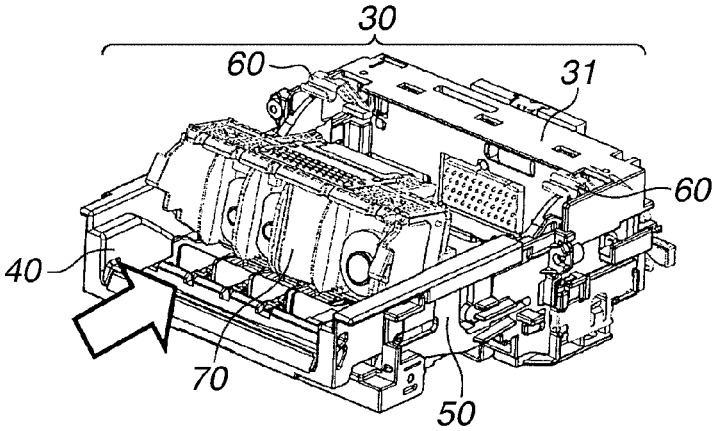
Figure 6A:
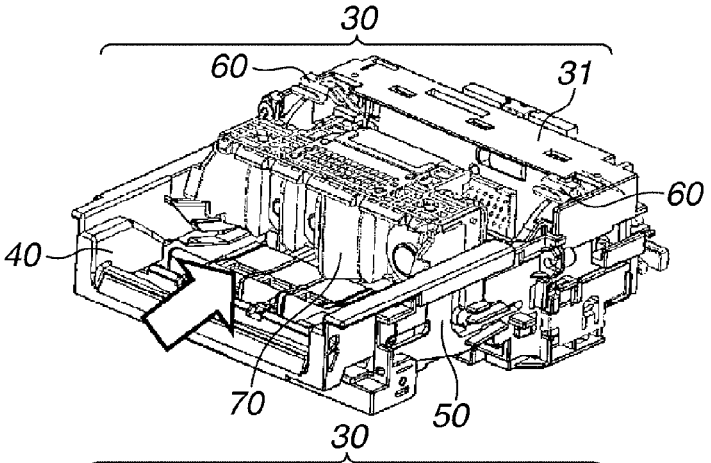
FIGS. 6A, 6B, 6C, and 6D are schematic perspective views for illustrating the recording head attaching operation.
Figure 6B:
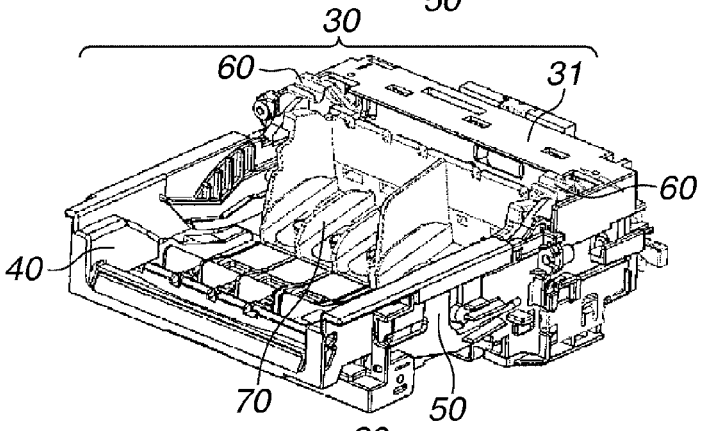

As illustrated in FIGS. 5D and 6A, by further forcing-in the recording head 70 in the direction of the arrow, the recording head 70 is guided by the second head guide portion 40*c* and the first head guide portion 40*b* as illustrated in FIG. 6B, and rotates while sinking below the carriage 31. At this time, also, with the regulation of the recording head 70 by the second head guide portion 40*c* and the first head guide portion 40*b*, it is possible to prevent the ink discharge portion 70*c* of the recording head 70 from coming into contact with a component of the recording unit 30 to suffer damage.

Figure 6C:
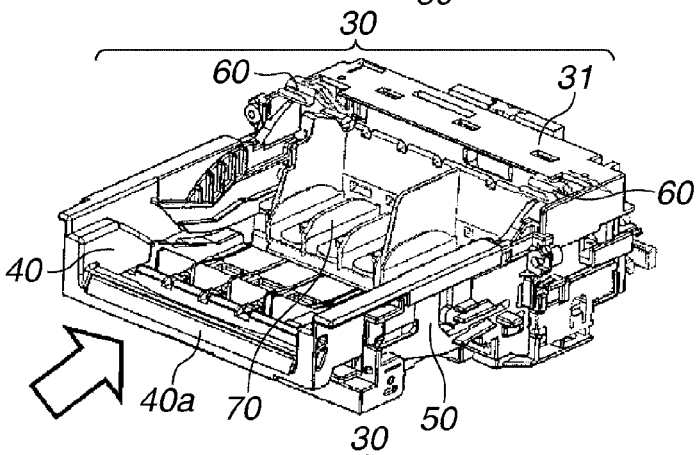
Figure 6D:
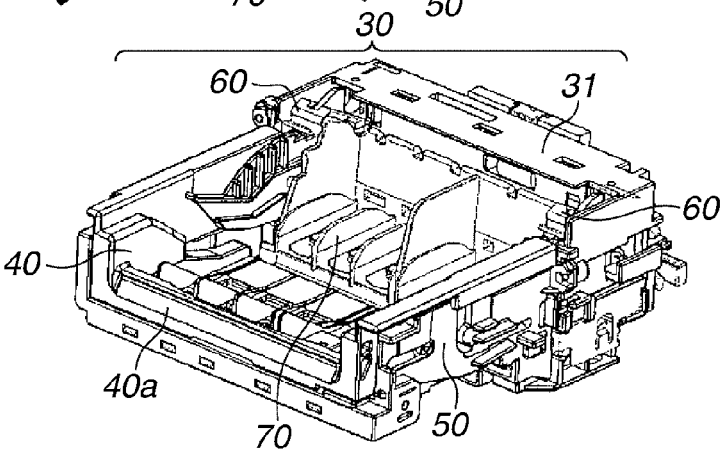

The recording head 70 rotated with respect to the carriage 31 is stabilized in the state illustrated in FIG. 6C. In the state illustrated in FIG. 6C, the operation portion 40*a* provided on the recording head attachment/detachment lever 40 is forced-in in the direction of the arrow, whereby the recording head fixation member 60 descends as illustrated in FIG. 6D, and contacts the recording head 70. As a result, the recording head fixation member 60 urges the recording head 70 toward the carriage 31 to fix it in position. In this state, the recording head fixation member 60 is separated from the recording head attachment/detachment lever 4, and the urging force of the recording head fixation member 60 is acting on the recording head 70.

When detaching the recording head 70 from the recording unit 30, it is possible to easily detach the recording head 70 via an operation reverse to the operation described above.

There may be a case in which the recording head 70 is to be attached to the carriage 31 in the state in which the recording head attachment/detachment lever 40 is situated at the closed position as illustrated in FIG. 5A, that is, in the state in which the recording head attachment/detachment lever 40 is not pulled to the front side of the recording apparatus 2. In this case, the first head guide portion 70*a* and the second head guide portion 70*b* of the recording head 70 are regulated by a recording head intrusion regulation portion 40*d* as a regulation member, making it impossible for the recording head 70 to be attached to the carriage 31. As a result, if the recording head attachment/detachment lever 40 is not opened (i.e., pulled in the direction of the arrow), the recording head 70 cannot be attached to the carriage 31.

Figure 7A:
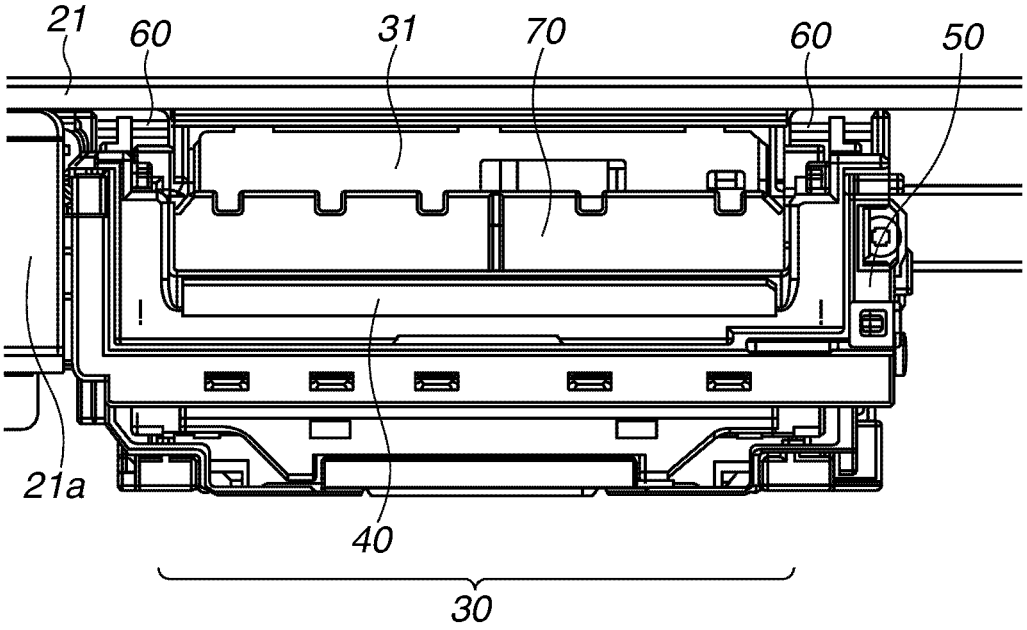
FIGS. 7A and 7B are schematic front views illustrating the states of a carriage at the time of the recording head attaching operation.
Figure 7B:
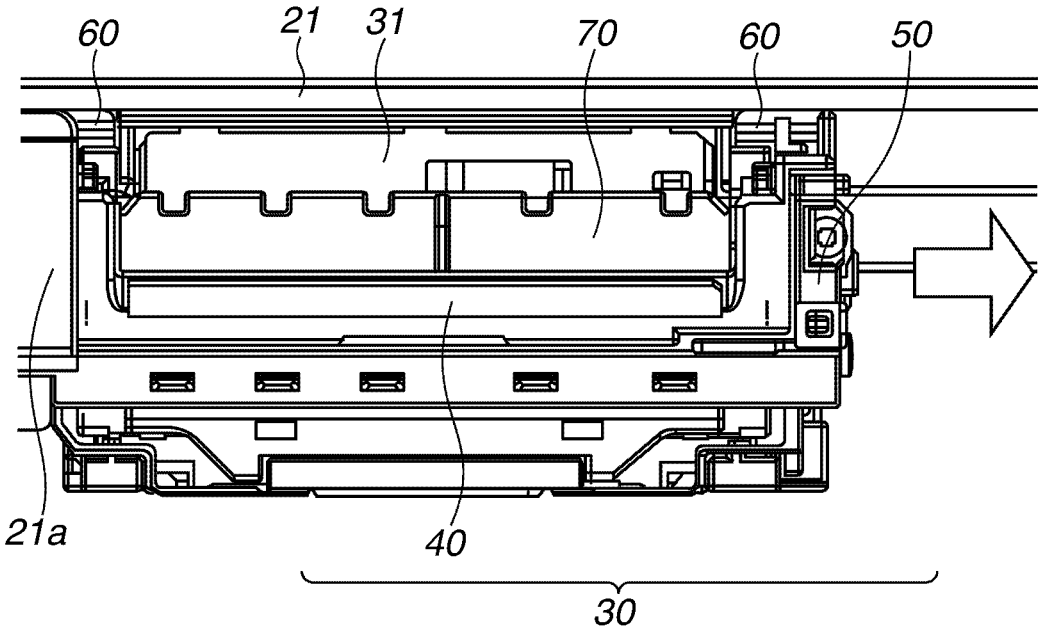

Next, the operation of attaching/detaching the recording head 70 according to the present exemplary embodiment will be described. The attachment of the recording head 70 and the attachment of the ink tank 80, which correspond to the difference in positions in the main scanning direction of the carriage 31, will be described with reference to FIGS. 2A and 2B, and 7A, and 7B. FIGS. 7A and 7B are front views schematically illustrating the state of the recording unit 30 at the time of the operation of attaching the recording head 70.

As illustrated in FIGS. 2A and 2B, when the operation unit 22 of the recording apparatus 2 is raised, the recording apparatus 2 undergoes transition to a replacement mode of an ink tank 80 based on a signal detecting the rise of the operation unit 22. FIG. 7B illustrates the state in which the ink tank 80 has undergone transition to the ink tank 80 replacement mode. In this state, the movement of the recording head attachment/detachment lever 40 is regulated by a lever regulation portion 21*a* of the exterior 21, and it is impossible to move the recording head attachment/detachment lever 40 to the opened position in which it has been pulled forwards. That is, when the carriage 31 is situated at this second position, it is possible to replace the ink tank 80, whereas it is impossible to replace the recording head 70. While, in the present exemplary embodiment, the transition to the replacement mode of the ink tank 80 is effected by raising the operation unit 22, this should not be construed restrictively. The transition may also be effected based on a signal accompanied with some other operation, or a signal detecting some other operation.

When, in the state illustrated in FIG. 7B, the button of the operation unit 22 is further depressed, the recording unit 30 moves to the right as seen from the front side of the recording apparatus 2, resulting in the state as illustrated in FIG. 7A. In the state illustrated in FIG. 7A, the movement of the recording head attachment/detachment lever 40 is not regulated by the lever regulation portion 21*a* of the exterior 21, so that it is possible to pull the recording head attachment/detachment lever 40 to the front side of the recording apparatus 2 to move it to the opened position. That is, when the carriage 31 is situated at a first position illustrated in FIG. 7A, it is possible to replace both the ink tank 80 and the recording head 70 with respect to the carriage 1. While, in the present exemplary embodiment, the transition to a replacement mode of the recording head 70 is effected in conjunction with the depression of the button of the operation unit 22, this should not be construed restrictively. The transition may also be effected based on a signal accompanied with some other operation, or a signal detecting some other operation. With this distinction between the state in which the ink tank 80 is replaceable and the state in which the recording head 70 is replaceable, it is possible to prevent the recording head 70 from being erroneously replaced, thus making it possible to avoid a malfunction.

As described above, according to the present exemplary embodiment, even in the case of a construction in which the upper portion of the carriage is unopenable to the exterior of the recording apparatus, it is possible to smoothly attach the recording head 70 to the carriage 31 while guiding the recording head. That is, even in a case where it is impossible to secure a sufficient space for the replacement of the recording head 70, it is possible to prevent damage on the recording head 70, and to smoothly attach the recording head 70 to the carriage 31.

Further, with the movement of the recording head attachment/detachment lever 40 substantially in the front-back direction of the recording apparatus 2, it is possible to attach and detach the recording head 70. That is, even in the case of the construction in which the upper portion of the carriage 31 of the recording unit 30 is unopenable to the exterior of the recording apparatus 2, it is possible to attach the recording head 70 to the carriage 31 substantially from the front side of the recording apparatus 2. The recording apparatus 2 allows the user to operate the apparatus in the front side thereof, thereby achieving an improvement in terms of operability.

Further, when the recording head attachment/detachment lever 40 is moved to the opened position, it is possible to attain the state in which the recording head 70 is attachable to the carriage 31. When the recording head attachment/detachment lever 40 is moved to the closed position, it is possible to regulate the attachment of the recording head 70 to the carriage 31, making it impossible to attach the recording head 70 to the carriage 31. That is, at the time of replacement of the recording head 70, it is possible to prevent damage on the recording head 70 and to smoothly attach the recording head 70 to the carriage 31. At the times other than that, it is possible to prevent the recording head 70 from being erroneously replaced.

In the main scanning direction of the carriage 31, it is possible to restrict the first position allowing the replacement of the recording head 70. When the ink tank 80 is to be attached and detached to and from the carriage 31, the carriage 31 is stopped at the second position in the main scanning direction different from the first position for the replacement of the recording head 70. Thus, it is possible to prevent erroneous replacement of the recording head 70.

As described above, according to the present exemplary embodiment, even in the case of a construction in which the upper portion of the carriage 31 is unopenable to the exterior of the recording apparatus 2, it is possible to attach the recording head 70 to the carriage 31 while the recording head is guided. As a result, even in the case of a construction in which it is impossible to secure a sufficient space for the replacement of the recording head 70, it is possible to smoothly attach the recording head 70 to the carriage 31 without damage on the recording head 70.

Further, the recording head attachment/detachment lever 40 moves in a direction orthogonal to the moving direction of the carriage 31 and parallel to the conveyance direction of the recording sheet, whereby the recording head 70 can be attached and detached to and from the carriage 31. That is, it possible to attach the recording head 70 to the carriage 31 substantially from the front side of the recording apparatus 2 without having to open the upper portion of the carriage 31 to the exterior of the recording apparatus 2. That enables the user to perform operation in the front side of the recording apparatus 2. As a result, it is possible to achieve an improvement in terms of user operability at the time of replacement of the recording head 70.

Further, the present exemplary embodiment can adopt a construction in which, when the recording head attachment/detachment lever 40 is at the opened position, it is possible to attach the recording head 70 to the carriage 31, and in which, when the recording head attachment/detachment lever 40 is at the closed position, the attachment of the recording head 70 to the carriage 31 is regulated. That is, at the time of replacement of the recording head 70, it is possible to smoothly attach the recording head 70 to the carriage 31 without damage on the recording head, and, at the times other than that, it is possible to prevent the recording head from being erroneously replaced.

Further, in the present exemplary embodiment, it is possible to restrict the position of the carriage 31 allowing the replacement of the recording head 70 in the main scanning direction of the carriage 31. That is, when the ink tank 80 is attached and detached to and from the carriage 31 of the recording unit, the carriage 31 is stopped at a position in the main scanning direction different from the position for the replacement of the recording head 70. That makes it is possible to prevent the recording head 70 from being erroneously replaced.

The above-described exemplary embodiment is applied to an inkjet-type recording apparatus configured to perform recording by discharging ink from the recording head 70. However, this should not be construed restrictively. The exemplary embodiment of the present invention is also applicable to other types of recording apparatus so long as they are ones in which a recording head is attached and detached to and from a recording unit. Further, the exemplary embodiment of the present invention is applicable independently of factors such as the number of recording heads and layout. When applied to an inkjet-type recording apparatus, the exemplary embodiment of the present invention is applicable independently of the kind, nature, etc. of the ink to be used.

Further, the exemplary embodiment of the present invention is not restricted to a single apparatus such as a printer, a copying machine, a facsimile apparatus, or an image forming apparatus. That is, the exemplary embodiment of the present invention is widely applicable also to a multifunction apparatus combining these, or a recording apparatus in a multifunction apparatus such as a computer system. Also regarding the recording material, the exemplary embodiment of the present invention is applicable to any kind of recording material of any form, such as paper, cloth, recording medium, such as CD or DVD, plastic sheet, overhead projector (OHP) sheet, or an envelope, so long as it allows image recording.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-212298 filed Sep. 26, 2012, which is hereby incorporated by reference herein in its entirety.

What is claimed is:

1. A recording apparatus comprising:

a carriage configured to perform scanning and to detachably hold a recording head for performing recording on a recording material;

a fixation member configured to be movable to a fixed position where the fixation member fixes the recording head to the carriage and to a retracted position where the fixation member retracts from the fixed position;

a moving member arranged to be movable to a first position and to a second position in a moving direction parallel to a conveyance direction of the recording material and configured to move the fixation member to the fixed position when the moving member moves to the first position and to move the fixation member to the retracted position when the moving member moves to the second position; and a guide portion provided on the moving member and configured to guide the recording head when the recording head is being attached to the carriage.

2. The recording apparatus according to claim 1, wherein, when the moving member has moved to the second position, the moving member allows the recording head to be moved to a head attachment position of the carriage while the guide portion guides the recording head.

3. The recording apparatus according to claim 1, wherein the moving member includes a regulation portion configured to regulate insertion of the recording head to the carriage when the moving member has moved to the first position.

4. The recording apparatus according to claim 1, wherein the carriage is movable to a first exchanging position where the moving member is allowed to move from the first position to the second position, and to a second exchanging position where the moving member is not allowed to move from the first position to the second position.

5. The recording apparatus according to claim 4, wherein a liquid tank storing liquid to be supplied to the recording head is attachable to and detachable from the carriage, wherein, when the carriage has moved to the first exchanging position, the recording head and the liquid tank are allowed to be attached to and detached from the carriage, and wherein, when the carriage has moved to the second exchanging position, the recording head is restricted from being attached to and detached from the carriage, while the liquid tank is allowed to be attached to and detached from the carriage.

6. A recording apparatus comprising:

a carriage configured to perform scanning and to detachably hold a recording head for performing recording on a recording material;

a fixation member configured to be movable to a fixed position where the fixation member fixes the recording head to the carriage and to a retracted position where the fixation member retracts from the fixed position;

a moving member arranged to be movable to a first position and to a second position in a front-back direction of the recording apparatus, and configured to move the fixation member to the fixed position when the moving member moves to the first position and to move the fixation member to the retracted position when the moving member moves to the second position; and a guide portion provided on the moving member and configured to guide the recording head when the recording head is being attached to the carriage.

7. The recording apparatus according to claim 6, wherein the recording material is discharged to a front side of the recording apparatus in the front-back direction.

8. The recording apparatus according to claim 6, wherein the fixation member is moved to the retracted position when the moving member has moved to a front side of the recording apparatus.

9. The recording apparatus according to claim 6, wherein the moving member is arranged to be movable in a moving direction parallel to a conveyance direction of the recording material.

10. The recording apparatus according to claim 6, wherein, when the moving member has moved to the second position, the moving member allows the recording head to be moved to a head attachment position of the carriage while the guide portion guides the recording head.

11. The recording apparatus according to claim 6, wherein the moving member includes a regulation portion configured to regulate insertion of the recording head to the carriage when the moving member has moved to the first position.

12. The recording apparatus according to claim 6, wherein the carriage is movable to a first exchanging position where the moving member is allowed to move from the first position to the second position, and to a second exchanging position where the moving member is not allowed to move from the first position to the second position.

13. The recording apparatus according to claim 12, wherein a liquid tank storing liquid to be supplied to the recording head is attachable to and detachable from the carriage, wherein, when the carriage has moved to the first exchanging position, the recording head and the liquid tank are allowed to be attached to and detached from the carriage, and wherein, when the carriage has moved to the second exchanging position, the recording head is restricted from being attached to and detached from the carriage, while the liquid tank is allowed to be attached to and detached from the carriage.

* * * * *